US007504022B2

(12) United States Patent
Picard

(10) Patent No.: US 7,504,022 B2
(45) Date of Patent: Mar. 17, 2009

(54) PROCESS FOR DESULPHURIZING GASOLINE BY CONVERTING SULPHUR-CONTAINING COMPOUNDS TO HIGHER BOILING POINT COMPOUNDS

(75) Inventor: Florent Picard, Communay (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 296 days.

(21) Appl. No.: 11/405,676

(22) Filed: Apr. 18, 2006

(65) Prior Publication Data

US 2007/0023324 A1 Feb. 1, 2007

(30) Foreign Application Priority Data

Apr. 19, 2005 (FR) ..... 05 03981

(51) Int. Cl.
*C10G 25/05* (2006.01)
*C07C 2/54* (2006.01)

(52) U.S. Cl. ..... 208/208 R; 208/213; 208/211; 585/446; 585/448; 585/456; 585/461; 585/510

(58) Field of Classification Search ..... 208/208 R, 208/213, 211; 585/446, 448, 456, 461, 510
See application file for complete search history.

(56) References Cited

U.S. PATENT DOCUMENTS

| | | | | |
|---|---|---|---|---|
| 5,863,419 | A | 1/1999 | Huff et al. | |
| 6,059,962 | A * | 5/2000 | Alexander et al. | 208/238 |
| 7,344,635 | B2 * | 3/2008 | Briot et al. | 208/208 R |
| 2005/0043573 | A1 * | 2/2005 | Ramprasad et al. | 585/24 |
| 2007/0241032 | A1 * | 10/2007 | Picard et al. | 208/245 |

* cited by examiner

*Primary Examiner*—Tam M Nguyen
(74) *Attorney, Agent, or Firm*—Millen, White, Zelano & Branigan, P.C.

(57) ABSTRACT

A process for desulphurizing a gasoline cut containing olefins, sulphur-containing compounds and optionally molecules belonging to C3 and C4 cuts comprises at least a first step A for contacting said gasoline cut with an acidic resin having an acid capacity of more than 4.7 equivalents per kg and a specific surface area of less than 55 $m^2/g$, and a second step B for fractionation of the mixture from the first step.

13 Claims, 2 Drawing Sheets

PROCESS FOR DESULPHURIZING GASOLINE BY CONVERTING SULPHUR-CONTAINING COMPOUNDS TO HIGHER BOILING POINT COMPOUNDS

FIELD OF THE INVENTION

The present invention relates to a process for reducing the amounts of sulphur contained in gasoline fractions.

More precisely, the invention concerns a layout for desulphurizing a gasoline cut comprising olefins. The present process is of particular application to the transformation of conversion gasoline, in particular gasoline from catalytic cracking, fluidized catalytic cracking (FCC), a cokefaction process, a visbreaking process or a pyrolysis process.

The process of the present invention allows a gasoline cut possibly comprising hydrocarbons containing two, three or four carbon atoms to be upgraded, thereby reducing the total sulphur content of said gasoline cut to very low levels, compatible with current or future specifications, without substantially reducing the gasoline yield and the octane number.

The production of gasoline satisfying new environmental regulations necessitates a substantial reduction in their sulphur content to values which in general do not exceed 50 ppm, and preferably are less than 10 ppm.

It is also known that conversion gasoline, more particularly those from catalytic cracking, which may represent 30% to 50% of the gasoline pool, have high olefin and sulphur contents.

Close to 90% of the sulphur present in gasoline can be attributed to gasoline from catalytic cracking processes, hereinafter termed FCC gasoline (fluidized catalytic cracking). FCC gas thus constitutes the preferred feed for the desulphurization process of the present invention.

More generally, the process of the invention is applicable to any gasoline cut containing a certain proportion of olefins and which may also contain several lighter compounds belonging to the C3 and C4 cuts. The gasoline feed for the present process may also be mixed with alcohols of the methanol or ethanol type or possibly heavier alcohols.

EXAMINATION OF THE PRIOR ART

A first desulphurization pathway which is routinely used in the refinery consists of gasoline hydrodesulphurization. To achieve the standards currently demanded using such processes, however, it appears necessary to operate under severe temperature and pressure conditions, in particular by operating at a high hydrogen pressure.

Such operating conditions generally entail at least partial hydrogenation of olefins, and consecutively a substantial reduction in the octane number of the desulphurized gasoline obtained by those processes.

A further pathway consists of using processes for desulphurizing gasoline based on an acidic catalyst treatment. That type of treatment is aimed at increasing the boiling point of the unsaturated thiophenic sulphur-containing compounds by addition (or alkylation) of said unsaturated sulphur-containing compounds to the olefins present in the feed and to a lesser extent, of oligomerizing a fraction of said olefins contained in the feed.

As an example, U.S. Pat. No. 6,059,962 and FR-A-2 810 671 describe such processes. Thiophenic unsaturated sulphur-containing compounds react with olefins in the presence of an acidic catalyst, the reaction causing conversion of said compounds to higher boiling point products. The thiols may also react with olefins to form sulphides which are also converted to higher boiling point products. The higher boiling point sulphur-containing compounds may then be separated by simple distillation. A low sulphur gasoline is recovered from the head of the distillation column.

In a similar process described in U.S. Pat. No. 5,863,419, the acidic catalyst may be placed directly in the distillation column. The higher boiling point sulphur-containing compounds are in this case extracted from the column bottom while the desulphurized gasoline is extracted overhead.

The acidic catalysts described in the above patents are generally solid catalysts having a Brönsted acidity, such as ion exchange resins or supported sulphuric or phosphoric acids.

U.S. Pat. No. 6,048,451 describes a desulphurization process by converting sulphur-containing compounds to higher boiling point products and compares the activities of various acidic catalysts. Of those catalysts, one resin, Amberlyst 35 sold by Rohm & Haas, was evaluated and exhibited an activity which was substantially lower than catalysts of the supported phosphoric acid or dealuminated zeolite type. That text thus does not lead the skilled person to use ion exchange resin type catalysts in an application for gasoline desulphurization.

BRIEF DESCRIPTION OF THE INVENTION

The present invention describes a process for desulphurizing olefinic gasoline by converting sulphur-containing compounds to higher boiling point products, based on an ion exchange resin type catalyst, having an acidity, measured by an acid capacity, of more than 4.7equivalents per kg, preferably more than 5.0 equivalents per kg, a specific surface area of less than 55 $m^2/g$, and preferably less than 50 $m^2/g$, and a pore volume of less than 0.50 ml/g, preferably less than 0.45 ml/g, more preferably less than 0.38 ml/g.

Such a catalyst will simply be termed a "resin" in the remainder of the text.

The process consists of bringing the feed to be desulphurized into contact with the resin having the characteristics described above. The feed may optionally be treated as a mixture with another hydrocarbon feed such as C3 or C4 fractions which are rich in olefins, or alcohols such as methanol, ethanol or heavier alcohols.

The operating conditions are adjusted to promote addition of olefinic compounds contained in the feed to the sulphur-containing compounds. The two principal desired reactions are the addition of olefins to thiophene and/or methylthiophenes, and possibly heavier thiophene compounds, and addition of olefins to mercaptans.

In parallel, olefin oligomerization reactions generally results in the formation of olefins generally containing more than 8 carbon atoms.

The product recovered at the reactor outlet is then distilled to recover at least one light sulphur-depleted fraction, constituting the desulphurized gasoline, and a heavy fraction which concentrates the higher boiling point sulphur-containing compounds.

During the step for reacting sulphur-containing compounds with olefins, heavy oligomers and polymers are generated by oligomerizing said olefins. Said heavy oligomers and polymers progressively deactivate the catalyst. The principal deactivation mechanisms encountered with resin type catalysts are as follows:

- deposits of polymers and oligomers on the catalyst;
- desulphonation of the catalyst under the effect of temperature;

neutralization of the acidic sites by basic compounds present in the feed which includes nitrogen-containing compounds.

DETAILED DESCRIPTION OF THE INVENTION

The present patent thus presents a novel process for desulphurization by addition of sulphur-containing compounds to olefins or a portion of said olefins contained in the feed to be treated, using as a catalyst an acidic ion exchange resin which comprises a copolymer of styrene and divinylbenzene onto which sulphonic acid groups have been grafted.

The acidic resin used in the present process is selected to have an improved activity and stability with respect to acidic resins used in the prior art for this type of application.

The process comprises at least the following two steps:

a first step A for contact, in a suitable reactor, of the feed to be treated with the resin, producing higher boiling point sulphur-containing compounds by an addition reaction of the olefins contained in the feed with the sulphur-containing compounds;

a step B for fractionation of the mixture from the first step which can produce a light fraction the sulphur content of which is reduced with respect to the feed, and a heavy fraction which concentrates the sulphur-containing compounds.

The sulphur content of the light fraction is generally sufficiently low for it to be incorporated directly into the gasoline pool.

The heavy fraction may be incorporated into the gasoline pool after desulphurization by hydrodesulphurization, for example, or it may be mixed with the middle distillate pool to produce a kerosene or gas oil cut.

The resin used in the context of the present invention also has an acid capacity of more than 4.7 equivalents per kg, preferably more than 5.0 equivalents per kg. The equivalents per kg corresponds to the number of moles of protons per kg of resin.

It has also been observed that the activity and stability of said resin were improved when the resin preferably exhibited at least one of the following characteristics:

a) the quantity of sulphur from sulphonic groups present in the resin is preferably over 15% by weight, more preferably in the range 18% by weight to 22% by weight;

b) the preferred resin for this application has a specific surface area of less than 55 $m^2/g$, more preferably in the range 25 $m^2/g$ to 50 $m^2/g$;

c) the pore volume of the resin is preferably in the range 0.10 ml/g to 0.50ml/g, more preferably in the range 0.15 ml/g to 0.40 ml/g, and still more preferably in the range 0.16 ml/g to 0.25 ml/g;

d) the mean pore diameter is preferably in the range 10 nm to 40 nm, more preferably in the range 20 nm to 30 nm, and still more preferably in the range 20 nm to 28 nm;

e) the resin is preferably formed into beads with a preferred granulometry in the range 0.3 mm to 1 mm, more preferably in the range 0.6 mm to 0.85mm.

It has been observed that using a resin of the invention can in the first place significantly improve the activity by converting the sulphur-containing compounds into to higher boiling point products, and hence operating at a lower temperature, which improves the service life of the resin, and in the second place, can reduce the rate of deactivation by polymer deposition.

In accordance with the present invention, the resin is used in a reactor under conditions such that the hydrocarbon fraction treated is in the liquid form.

A number of implementational solutions may be envisaged for the resin, such as a fixed bed reactor, a multi-tube reactor, chamber reactors, ebullated bed reactors, moving bed reactors or fluidized bed reactors. However, implementations are preferably used which can control the thermal profile in the reactor. Reactions for converting sulphur-containing compounds to higher boiling point products and olefin oligomerization reactions are exothermic. Since resins are solids which may degrade at high temperature, it is preferable to control the thermal profile of the reactor.

In a fixed bed, this may be carried out by recycling part of the effluent to the reactor to limit the rate of olefin conversion per pass, and thus to control the temperature rise in the reactor.

In an ebullated bed, the temperature rise in the reactor is generally easier to control using exchange surfaces directly immersed in the reaction medium, avoiding the occurrence of hot spots in the reactor.

The catalyst may be placed in a single reactor or, as is preferable, in a number of reactors operated in parallel or in series. This device is advantageously used in the present invention as it allows the reactor to be stopped at any time to replace the used catalyst while maintaining continuous operation of the unit.

When the reactors are operated in series, a heat exchanger may be interposed between each reactor to adjust the inlet temperature for each reactor of the series independently.

The process of the invention is particularly suitable for the treatment of gasoline containing sulphur and olefins. These compounds are simultaneously present in conversion gasoline, in particular gasoline from catalytic cracking, fluidized catalytic cracking (FCC), a cokefaction process, a visbreaking process, or a pyrolysis process. These gasolines generally contain at least 30 ppm of sulphur and 10% of olefins.

The end point of the feed is generally less than 230° C., but it is preferable to treat gasoline with a boiling point of less than 160° C., preferably less than 130° C. The feed may also contain hydrocarbon fractions containing 3 or 4 carbon atoms.

In a preferred implementation of the invention, the treated feed is initially freed of light cuts which concentrates the olefins containing 5 or fewer carbon atoms, as well as lighter sulphur-containing compounds such as thiophene.

With FCC gasolines, these light sulphur-containing compounds are principally mercaptans which may be eliminated during a specific treatment step, such as extractive oxidation or thioetherification.

In accordance with a particular implementation of the invention, it is possible to add to the feed oxygen-containing compounds in the form of alcohols such as methanol or ethanol.

These alcohol compounds may then react with the olefins present in the feed to form ethers which have a good octane number, and which may be incorporated into the gasoline pool.

The feed may optionally undergo pre-treatment intended to reduce the nitrogen-Containing compound content. Any solution known to the skilled person to carry out said reduction in nitrogen-containing compounds may be envisaged.

This step may, for example, consist of washing the feed with an aqueous acidic solution or treating the gasoline on an acidic guard bed composed of a zeolite, an acidic resin or any other solid which can retain basic nitrogen-containing compounds.

A preferred solution for trapping nitrogen-containing compounds consists of using partially used resin of the invention in the guard bed. In this case, the device must include at least two reactors, a first reactor containing used resin, operated so as to trap at least a fraction of the nitrogen-containing compounds, and a second reactor containing the active resin used to convert the sulphur-containing compounds to higher boiling point products.

When the activity of the resin used in the second reactor is zero or is no longer sufficient, it may be used in the guard bed.

The step for extracting nitrogen-containing compounds is generally necessary if the feed contains more than 50 ppm of nitrogen, or even more than 20 ppm of nitrogen.

Further, the feed may also undergo a pre-treatment intended to selectively hydrogenate diolefins. In fact, the cracking gasoline generally contain diolefins in an amount of 1% by weight to 3% by weight. Said diolefins are highly reactive in polymerization, and may cause premature deactivation of the resin by polymer deposition.

Pre-treatment processes which are applicable to the process are described in patents FR-A-2 847 260 and FR-A-2 850 113. When the gasoline is treated using the process described in those patents, in addition to diolefins, it undergoes a transformation of the sulphur-containing compounds which are lighter than the thiophene principally present in the form of mercaptans, into sulphur-containing compounds which are heavier (i.e. have higher boiling points) than thiophene.

The operating conditions for the step for converting the sulphur-containing compounds to higher boiling point products must be optimized to produce gasoline satisfying the required specifications.

The operating pressure is generally higher than 0.5 MPa, and preferably more than 1 MPa (1 MPa=$10^6$ pascals); the pressure is adjusted to maintain the reaction mixture in the liquid phase in the reactor.

The HSV is in the range 0.2 $h^{-1}$ to 5 $h^{-1}$, preferably in the range 0.5 $h^{-1}$ to 3 $h^{-1}$, per reactor.

The temperature is adjusted to achieve the desired degree of transformation for the sulphur-containing compounds. Preferably, the temperature is adjusted so as not to exceed the envisaged degrees of conversion, in particular to convert a maximum of 99% of the sulphur in the thiophene form present in the feed.

The preferred degree of conversion for the thiophene is less than 99%, preferably less than 98%. Higher conversions generally necessitate operating the resin at a higher temperature, which causes accelerated deactivation by polymer deposition. The operating temperatures are generally in the range 50° C. to 150° C., preferably in the range 60° C. to 140° C.

EXAMPLE

In this example, three commercial resins were compared. The first was a prior art resin, the second was in accordance with the invention, the third was also in accordance with the invention but with a higher concentration of acidic sites and a lower specific surface area than the second.

The characteristics of the resins used are shown in Table 1. Those resins comprised a copolymer of styrene and divinylbenzene onto which sulphonic acid groups had been grafted.

TABLE 1

| Resin | Concentration of acid sites, eq/kg | Specific surface area, $m^2/g$ | Mean pore diameter, nm | Total pore volume, ml/g |
|---|---|---|---|---|
| 1, prior art | 4.7 | 53 | 30 | 0.40 |
| 2, according to the invention | 5.2 | 50 | 30 | 0.35 |
| 3, according to the invention | 5.4 | 33 | 24 | 0.20 |

Feed A used to evaluate these catalysts was a FCC gasoline the principal characteristics of which are given in Table 2.

TABLE 2

| Feed A | Analysis |
|---|---|
| 15/4 density | 0.6937 |
| Analysis of sulphur-containing compounds | |
| Total S, ppm by weight | 410 |
| Analysis of sulphur-containing compounds | |
| Thiophene, ppm by weight | 83.5 |
| C1-thiophene, ppm by weight | 162.11 |
| Analysis of hydrocarbons | |
| n-paraffins, wt % | 4.6 |
| Iso-paraffins, wt % | 32.8 |
| Naphthene, wt % | 8.2 |
| Aromatics, wt % | 5.2 |
| Olefins | 49.2 |
| Simulated distillation | |
| 5% by weight | 23.3 |
| 10% by weight | 26.2 |
| 50% by weight | 69.0 |
| 95% by weight | 112.3 |
| 98% by weight | 121.4 |
| Total nitrogen, ppm by weight | 14.4 |

Resin Activity Investigation

The activity of resins 1, 2 and 3 was evaluated during a test carried out using a traversed bed reactor.

60 ml of catalyst was loaded into the reactor. Feed A was injected at a temperature of 70° C., a flow rate of 50 ml/h and a pressure of 2 MPa.

Figure 1:
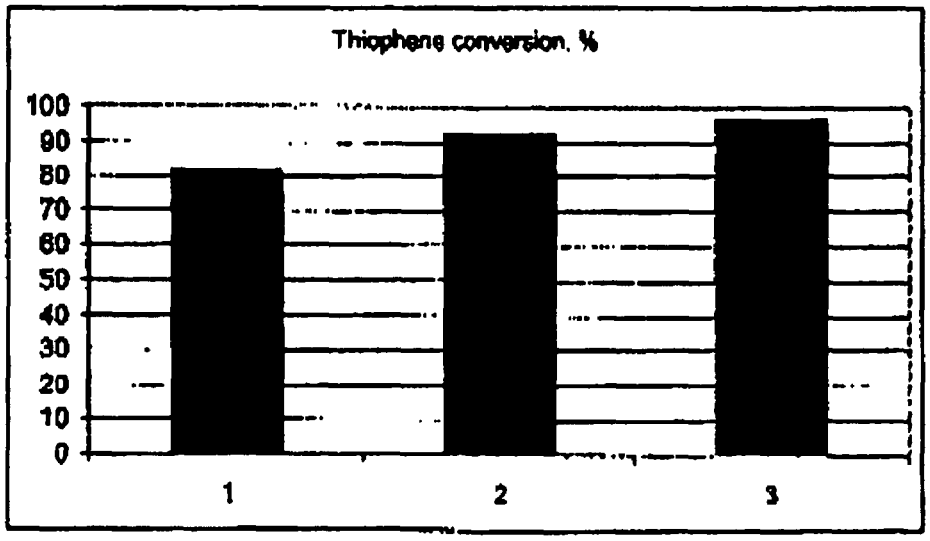
FIG. 1 is a bar graph showing the degree of thiophene conversion for the three catalysts.

After 48 hours, a sample of the test liquid was recovered and analyzed by gas chromatography with a detector specific for sulphur, to measure the degree of conversion of thiophene compounds. FIG. 1 shows the degree of conversion of thiophene for the three catalysts.

The most active resin was resin 3 in accordance with the invention. These tests show that resins 2 and 3 had activities of more than 90%, significantly higher than that of resin 1.

Resin Stability Investigation

The stabilities of resins 1 and 3 were compared during two tests of about 400 hours. For each test, 60 ml of resin was loaded into a reactor. The pressure and flow rates were maintained constant and equal to 2 MPa and 50 ml/h respectively.

Figure 2:
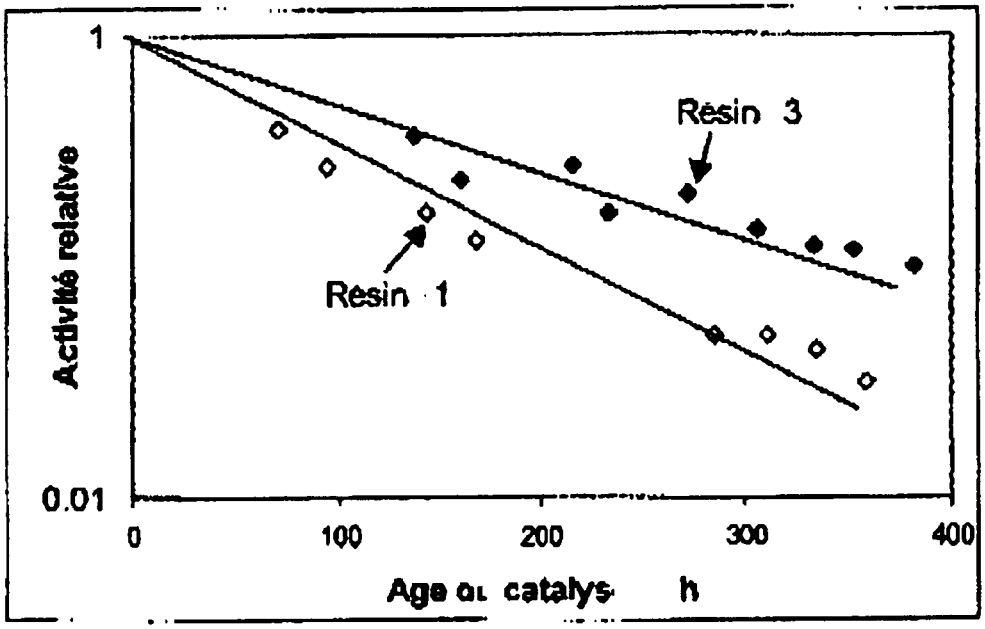
FIG. 2 is a graph showing the relative activity of two of the catalysts as a function of time.

A sample was periodically recovered and analyzed by gas chromatography using a specific detector for sulphur-containing compounds. The degree of conversion of the thiophene was then calculated with respect to the amount of thiophene in the feed, which allowed the change in the activity of the catalyst to be monitored. The temperature was adjusted during the test to maintain a degree of thiophene conversion of 90% to 99%. FIG. 2 shows the change in the relative activity of the two resins as a function of time.

Resin 3 had a shallower deactivation slope than resin 1. The loss of activity of resin 3 observed after 300 hours was equivalent to the loss of activity of resin 1 after 150 hours. It is thus highly advantageous to use resin 3, which is about twice as stable as resin 1.

Resin 3 of the invention is thus better suited to converting sulphur-containing compounds to higher boiling point products and also has better activity and better stability.

In the above description of the invention, there is disclosed the use of ion-exchange resin having particular characteristics. The same characteristics may be found in resin which are not characterized as ion exchange resins. Furthermore, other ion exchange resins having the desired characteristics may be equivalent in systems other than copolymers of divinyl benzene and styrene having grafted sulfonic acid groups.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 05/03981, filed Apr. 19, 2005 are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for desulphurizing a gasoline cut containing olefins, sulphur-containing compounds and optionally molecules from C3 and C4 cuts, comprising at least:

a first step A for contacting said gasoline cut with an acidic resin producing higher boiling point sulphur-containing compounds by an addition reaction between the olefins and sulphur-containing compounds of said gasoline cut;

a step B for fractionation of resultant gasoline cut containing reaction product from the first step to produce a light fraction the sulphur content of which is reduced with respect to the feed, and a higher boiling point fraction which concentrates the sulphur-containing compounds;

in which the resin used in step A has an acid capacity of more than 4.7 equivalents per kg, a specific surface area of less than 55 $m^2/g$ and a pore volume in the range of 0.16 ml/g to 0.25 ml/g.

2. A process for desulphurizing a gasoline cut containing olefins, sulphur-containing compounds and optionally molecules from C3 and C4 cuts according to claim 1, in which the resin has an acid capacity of more than 5.0 equivalents per kg and a specific surface area which is 50 $m^2/g$ or less.

3. A process for desulphurizing a gasoline cut containing olefins, sulphur-containing compounds and optionally molecules from C3 and C4 cuts according to claim 1, said gasoline cut containing thiophene and wherein the thiophene degree of conversion is at least 90% but less than 99%.

4. A process for desulphurizing a gasoline cut according to claim 1 in which the operating temperature is of 50° C. to 150° C., and the operating pressure is more than 0.5 MPa.

5. A process according to claim 1, in which the HSV is in the range 0.2 $h^{-1}$ to 5 $h^{-1}$.

6. A process for desulphurizing a gasoline cut according to claim 1, in which when the feed to be treated contains more than 50 ppm of nitrogen, and comprising pre-treating said feed in a unit for extracting nitrogen-containing compounds employing a resin which has been previously used in the desulphurizing reaction step.

7. A process for desulphurizing a gasoline cut according to claim 1, in which the acidic resin is distributed between a plurality of fixed beds functioning in parallel, the size of the catalyst particles being in the range 0.3 mm to 1 mm.

8. A process for desulphurizing a gasoline cut according to claim 1, in which the acidic resin is distributed between a plurality of fixed beds functioning in series, a heat exchanger being interposed between each reactor.

9. A process for desulphurizing a gasoline cut according to claim 1, wherein said first step is conducted in an ebullated bed of acidic resin.

10. A process according to claim 3 wherein the thiophene conversion is less than 98%.

11. A process according to claim 4 wherein the operating temperature is 60° C. to 140° C. and the operating pressure is more than 1 Mpa.

12. A process according to claim 1 wherein the acidic resin is an ion exchange resin.

13. A process according to claim 12 wherein the ion exchange resin comprises a copolymer of styrene and vinyl benzene grafted with sulfonic acid groups.

* * * * *